US010560786B2

(12) United States Patent
Cevette et al.

(10) Patent No.: US 10,560,786 B2
(45) Date of Patent: Feb. 11, 2020

(54) SPEECH INTELLIGIBILITY ENHANCEMENT SYSTEM

(71) Applicants: Mayo Foundation for Medical Education and Research, Rochester, MN (US); Etymotic Research, Inc., Elk Grove Village, IL (US)

(72) Inventors: Michael J. Cevette, Scottsdale, AZ (US); Jan Stepanek, Scottsdale, AZ (US); Mead C. Killion, Elk Grove Village, IL (US); Charles J. Aldous, Bensenville, IL (US)

(73) Assignee: Mayo Foundation for Medical Education and Research, Rochester, MN (US)

( * ) Notice: Subject to any disclaimer, the term of this patent is extended or adjusted under 35 U.S.C. 154(b) by 61 days.

(21) Appl. No.: 15/548,660

(22) PCT Filed: Feb. 1, 2016

(86) PCT No.: PCT/US2016/015995

§ 371 (c)(1),
(2) Date: Aug. 3, 2017

(87) PCT Pub. No.: WO2016/126614

PCT Pub. Date: Aug. 11, 2016

(65) Prior Publication Data

US 2018/0035214 A1 Feb. 1, 2018

Related U.S. Application Data

(60) Provisional application No. 62/111,930, filed on Feb. 4, 2015.

(51) Int. Cl.

| | |
|---|---|
| ***H04R 25/00*** | (2006.01) |
| ***G10L 21/0364*** | (2013.01) |
| ***G10L 21/02*** | (2013.01) |

(52) U.S. Cl.
CPC ..... *H04R 25/356* (2013.01); *G10L 21/0202* (2013.01); *G10L 21/0364* (2013.01);
(Continued)

(58) Field of Classification Search
CPC .. H04R 25/356; H04R 25/554; H04R 25/558; H04R 25/30; H04R 2225/43;
(Continued)

(56) References Cited

U.S. PATENT DOCUMENTS

| | | | |
|---|---|---|---|
| 4,837,832 | A | 6/1989 | Fanshel |
| 5,128,566 | A | 7/1992 | Killion et al. |

(Continued)

FOREIGN PATENT DOCUMENTS

| | | | |
|---|---|---|---|
| JP | 3187151 | B2 | 2/1994 |
| JP | 2001508261 | A | 6/2001 |

(Continued)

OTHER PUBLICATIONS

Author Unknown. "Developing and Testing a Laboratory Sound System That Yields Accurate Real-World Results." Hearingreview.com, pp. 54-61, Oct. 2007.

(Continued)

*Primary Examiner* — Brian Ensey

(57) ABSTRACT

A speech intelligibility system. Embodiments comprise a talker unit, a listener unit and an earpiece. The talker unit includes a microphone to receive audible speech content and to produce electrical signals representative of the speech content, and a transmitter coupled to the microphone to produce wireless transmissions containing the speech content. The listener unit includes a receiver to receive the wireless transmissions and to produce electrical signals representative of the speech content. At least one of the talker unit and the listener unit includes an amplifier to amplify spectral components of the speech content within a (Continued)

frequency range having a lower end between about 800 Hz and 1,700 Hz and an upper end between about 7,000 Hz and 11,000 Hz. The earpiece is coupled to the listener unit and includes a speaker to produce audible speech content having the amplified spectral components and a tube to direct the audible speech content from the speaker toward a user's ear canal.

25 Claims, 8 Drawing Sheets

(52) U.S. Cl.
CPC ..... *H04R 25/554* (2013.01); *H04R 25/30* (2013.01); *H04R 25/558* (2013.01); *H04R 2225/43* (2013.01); *H04R 2225/61* (2013.01); *H04R 2227/009* (2013.01); *H04R 2420/07* (2013.01); *H04R 2430/01* (2013.01)

(58) Field of Classification Search
CPC ..... H04R 2225/61; H04R 2420/07; H04R 2430/01; G10L 21/0364; G10L 21/0202
See application file for complete search history.

(56) References Cited

U.S. PATENT DOCUMENTS

| | | | | |
|---|---|---|---|---|
| 5,131,046 | A | 7/1992 | Killion et al. | |
| 5,144,675 | A | 9/1992 | Killion et al. | |
| 5,524,056 | A | 6/1996 | Killion et al. | |
| 5,761,319 | A | 6/1998 | Dar et al. | |
| 5,878,147 | A | 3/1999 | Killion et al. | |
| 5,966,639 | A | 10/1999 | Goldberg et al. | |
| 6,009,183 | A | 12/1999 | Taenzer et al. | |
| 6,021,207 | A | 2/2000 | Puthuff et al. | |
| 6,075,869 | A | 6/2000 | Killion et al. | |
| 6,098,463 | A | 8/2000 | Goldberg | |
| 6,101,258 | A | 8/2000 | Killion et al. | |
| 6,101,259 | A * | 8/2000 | Rapps | H04R 25/65 181/129 |
| 6,134,334 | A | 10/2000 | Killion et al. | |
| 6,275,596 | B1 | 8/2001 | Fretz et al. | |
| 6,285,771 | B1 | 9/2001 | Killion et al. | |
| 6,327,370 | B1 | 12/2001 | Killion et al. | |
| 6,567,526 | B1 | 5/2003 | Killion et al. | |
| 6,704,423 | B2 | 3/2004 | Anderson et al. | |
| 6,731,768 | B1 | 5/2004 | Delage | |
| 6,798,890 | B2 | 9/2004 | Killion et al. | |
| 6,831,987 | B2 | 12/2004 | Killion et al. | |
| 6,876,749 | B1 | 4/2005 | Killion et al. | |
| 6,993,480 | B1 * | 1/2006 | Klayman | G10L 21/0364 704/225 |
| 7,003,126 | B2 | 2/2006 | Killion et al. | |
| 7,103,191 | B1 | 9/2006 | Killion | |
| 7,110,553 | B1 | 9/2006 | Julstrom et al. | |
| 7,245,728 | B2 | 7/2007 | Killion et al. | |
| 7,286,677 | B2 | 10/2007 | Killion et al. | |
| 7,452,337 | B2 | 11/2008 | Iseberg | |
| 7,460,677 | B1 | 12/2008 | Soede et al. | |
| 7,551,940 | B2 | 6/2009 | Paulson et al. | |
| 7,590,253 | B2 | 9/2009 | Killion | |
| 7,764,801 | B2 | 7/2010 | Soede et al. | |
| 7,832,080 | B2 | 11/2010 | Killion et al. | |
| 7,881,486 | B1 | 2/2011 | Killion et al. | |
| 7,991,179 | B2 | 8/2011 | Drambarean et al. | |
| 8,019,386 | B2 | 9/2011 | Dunn et al. | |
| 8,022,775 | B2 | 9/2011 | Julstrom et al. | |
| 8,150,057 | B2 | 4/2012 | Dunn | |
| 8,160,284 | B2 | 4/2012 | Johnson et al. | |
| 8,170,262 | B1 | 5/2012 | Liu | |
| 8,249,285 | B2 | 8/2012 | Killion et al. | |
| 8,322,222 | B2 | 12/2012 | Goldberg et al. | |
| 8,649,546 | B2 | 2/2014 | Haapapuro et al. | |
| 8,660,282 | B2 | 2/2014 | Johnson et al. | |
| 8,750,544 | B2 | 6/2014 | Killion et al. | |
| 9,066,169 | B2 | 6/2015 | Dunn | |
| 9,155,494 | B2 | 10/2015 | Iseberg et al. | |
| 9,222,827 | B2 | 12/2015 | Killion | |
| 9,859,990 | B2 | 1/2018 | Julstrom | |
| 2003/0064746 | A1 | 4/2003 | Rader et al. | |
| 2004/0125979 | A1 | 7/2004 | Elidan et al. | |
| 2005/0195996 | A1 | 9/2005 | Dunn et al. | |
| 2006/0023909 | A1 | 2/2006 | Grafenberg | |
| 2008/0101635 | A1 * | 5/2008 | Dijkstra | H04R 25/30 381/315 |
| 2008/0240458 | A1 | 10/2008 | Goldstein et al. | |
| 2008/0249772 | A1 | 10/2008 | Martynovich et al. | |
| 2010/0166209 | A1 | 7/2010 | Dunn | |
| 2010/0303249 | A1 * | 12/2010 | Semcken | G10L 21/02 381/58 |
| 2011/0117975 | A1 | 5/2011 | Dunn et al. | |
| 2012/0128178 | A1 | 5/2012 | Fujii | |
| 2013/0337786 | A1 | 12/2013 | Park | |
| 2016/0113554 | A1 | 4/2016 | Iseberg et al. | |
| 2016/0323043 | A1 | 11/2016 | Julstrom | |
| 2017/0041728 | A1 | 2/2017 | Killion | |
| 2017/0272850 | A1 * | 9/2017 | Mihara | H04R 5/033 |
| 2018/0091238 | A1 | 3/2018 | Julstrom | |
| 2018/0310103 | A1 | 10/2018 | Cevette et al. | |

FOREIGN PATENT DOCUMENTS

| | | | |
|---|---|---|---|
| JP | 2001510976 | A | 8/2001 |
| JP | 2002125300 | A | 4/2002 |
| JP | 2003511940 | A | 3/2003 |
| JP | 2004343446 | A | 12/2004 |
| JP | 2006180448 | A | 7/2006 |
| JP | 2008258878 | A | 10/2008 |
| JP | 6164799 | B2 | 11/2012 |
| JP | 2013247559 | A | 12/2013 |
| JP | 2014072790 | A | 4/2014 |

OTHER PUBLICATIONS

International Preliminary Report on Patentability issued in PCT/US2016/015995, dated Aug. 17, 2017, 10 pages.
International Search Report and Written Opinion issued in PCT/US2016/015995, dated Jun. 29, 2016, 13 pages.
RFSafe. "Law Enforcement Style Mono Ear Hook Acoustic Tube Headset (Single Bud)" [online], [retrieved Mar. 7, 2018]. Retrieved from the Internet <URL:https://www.rfsafe.com/product/law-enforcement-style-mono-ear-hook-acoustic-tube-headset-single-bud/>. Available at least as early as Aug. 31, 2017, 4 pages.
Supplementary Partial European Search Report issued in EP Application 16747063.2, dated Jul. 24, 2018, 12 pages.
Amendment filed in U.S. Appl. No. 16/023,639 dated Dec. 7, 2018, 9 pages.
Application filed in U.S. Appl. No. 16/023,639 dated Jun. 29, 2018, 20 pages.
Mueller, H. G., et al. An Easy Method for Calculating the Articulation Index. The Hearing Journal, 43(9):1-4, Sep. 1990.
Non-final Office Action issued in U.S. Appl. No. 16/023,639 dated Aug. 9, 2018, 21 pages.

* cited by examiner

SPEECH INTELLIGIBILITY ENHANCEMENT SYSTEM

CROSS REFERENCE TO RELATED APPLICATION

This application is a national phase application of PCT Application No. PCT/US2016/015995A, internationally filed Feb. 1, 2016 and entitled SPEECH INTELLIGIBILITY ENHANCEMENT SYSTEM, which claims the benefit of U.S. Provisional Application No. 62/111,930, filed Feb. 4, 2015 and entitled SPEECH INTELLIGIBILITY ENHANCEMENT SYSTEM, which are both incorporated herein by reference in their entireties and for all purposes.

TECHNICAL FIELD

The invention is a system for processing and reproducing speech to enhance its intelligibility for hearing impaired individuals.

BACKGROUND

Hearing impairment detracts from the quality of life of a substantial portion of the population. Problems caused by hearing loss can range from a source of frustration to depression and withdrawal.

The ability of hearing impaired individuals to understand speech, also sometimes known as the intelligibility of speech, is limited by a number of factors. One is the level of ambient noise in the environment in which the speech is occurring. Another is the inability of the hearing impaired to hear the very soft levels of the important high frequency components of human speech. Reverberation from room acoustics also limits hearing impaired individuals' ability to understand speech.

Systems for enhancing the intelligibility of speech are generally known and disclosed, for example, in the Klayman U.S. Pat. No. 6,993,480 and the Dunn et al. U.S. Patent Application Publications 2005/0195996 and 2010/0166209, which are incorporated herein by reference in their entirety for all purposes. There remains, however, a continuing need for improved systems to enhance the intelligibility of speech for the hearing impaired.

SUMMARY

An embodiment of a speech intelligibility enhancement system comprises a talker unit, a listener unit and an earpiece. The talker unit includes a microphone to receive audible speech content and to produce electrical signals representative of the speech content, and a transmitter coupled to the microphone to produce wireless transmissions containing the speech content. The listener unit includes a receiver to receive the wireless transmissions and to produce electrical signals representative of the speech content. At least one of the talker unit and the listener unit includes an amplifier to amplify spectral components of the speech content within a frequency range having a lower end between about 800 Hz and 1,700 Hz and an upper end between about 7,000 Hz and 11,000 Hz. The earpiece is coupled to the listener unit and includes a speaker to produce audible speech content having the amplified spectral components and a tube to direct the audible speech content from the speaker toward a user's ear canal.

DETAILED DESCRIPTION

Figure 1:
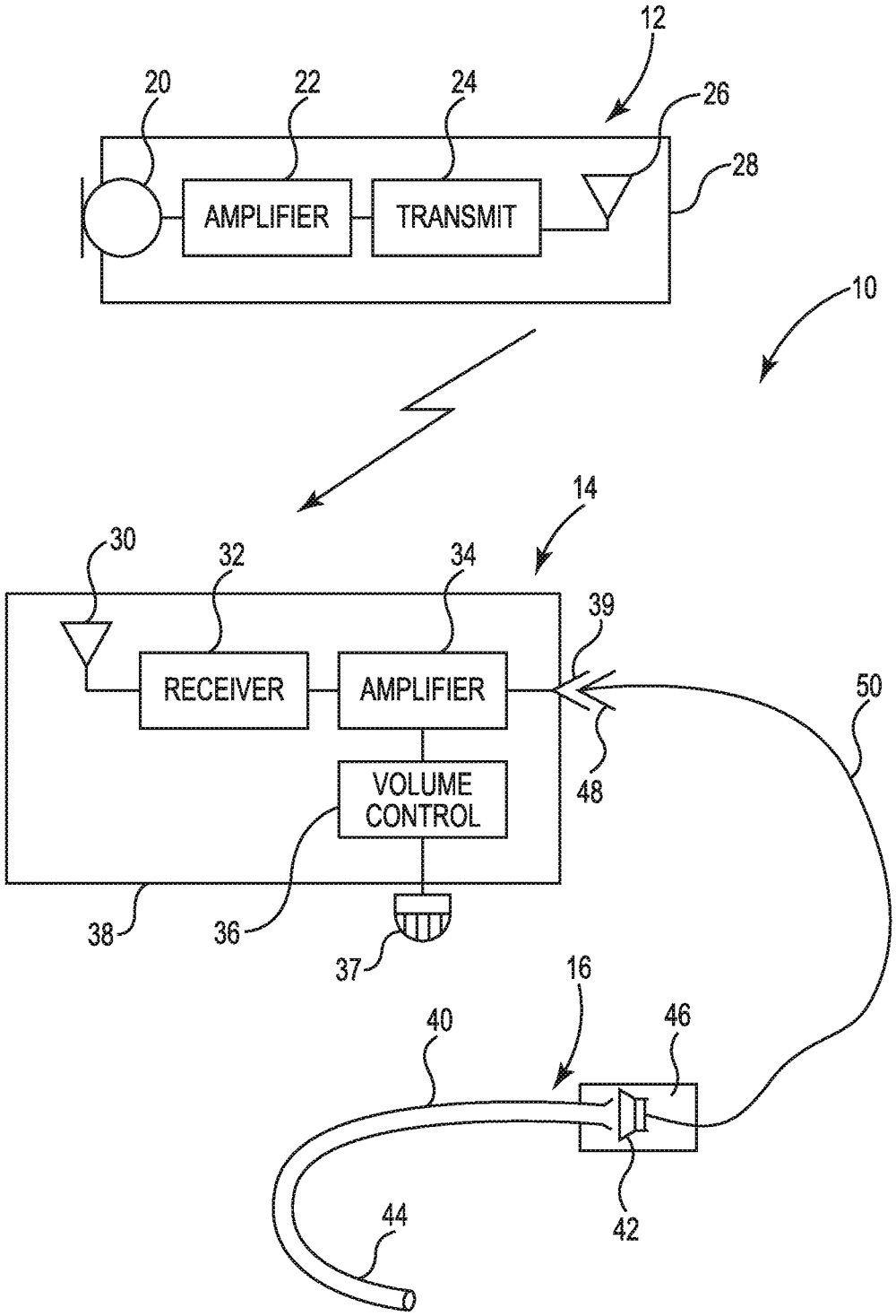
FIG. 1 is a block diagram of a speech intelligibility enhancement system in accordance with embodiments of the present invention.

A speech intelligibility enhancement system 10 in accordance with embodiments of the invention is shown in FIG. 1. System 10 includes a talker unit 12, a receiver or listener unit 14, and an earpiece 16. The illustrated embodiment of the talker unit 12, which can be a portable device, includes a microphone 20, amplifier 22, transmitter 24 and antenna 26 mounted to or within a housing 28. Human speech is received by microphone 20. Microphone 20 converts the speech to an electric signal containing the information or content of the speech. Amplifier 22 processes (e.g., amplifies) the electric speech content signal. The amplified speech content signal is modulated for wireless transmission by transmitter 24, and is transmitted from the talker unit 12 through the antenna 26. Transmitter 24 can implement any suitable or desired modulation and transmission protocol such as Bluetooth, frequency modulation (FM) or amplitude modulation (AM). Listener unit 14 includes an antenna 30, receiver 32, amplifier 34, volume control 36 with control knob 37 and output connection or jack 39 mounted to or within a housing 38. The wireless speech content signals from the talker unit 12 are received by antenna 30 and demodulated by the receiver 32. Amplifier 34 processes the demodulated speech content signals, including adjusting the speech content signals to a level controlled by volume control 36 and set by a user through the use of knob 37. The amplified speech content signals are then outputted from the listener unit 14 through the jack 39. Earpiece 16 includes an ear hook 40, speaker 42 and sound distribution tube 44. In the illustrated embodiment the speaker 42 is mounted within a housing 46 on the ear hook 40. The speaker 42 is also coupled through wires 50 to a plug 48 that connects to the jack 39 of the listener unit 14. The ear hook 40 is part of the sound distribution tube 44 in the illustrated embodiment. Electric speech content signals from the listener unit 14 are coupled to the speaker 42 through the plug 48 and wires 50. Speaker 42 generates audible speech content from the speech signals, and the audible speech content is directed to the ear canal of a user wearing the earpiece 16 through the tube 44.

To enhance the intelligibility of the audible speech provided to the user by system 10, one or both of the talker unit amplifier 22 and the listener unit amplifier 34 selectively amplifies the spectral or frequency content of the speech signals. In some embodiments of the invention, the selective amplification is provided solely by the amplifier 22 of the talker unit 12. Amplifiers 22 and/or 34 can be of conventional or otherwise known design, and can provide amplification by conventional or otherwise known approaches such as by providing positive gain and/or through filtering (i.e., negative gain).

Figure 2:
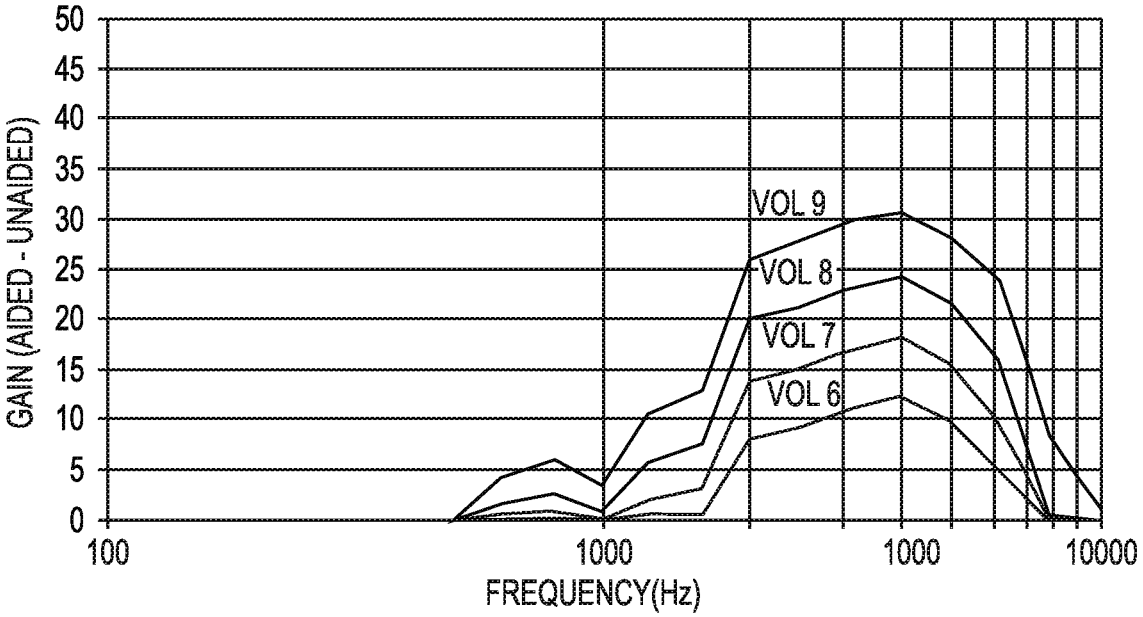
FIG. 2 is a graph of gain vs. frequency that can be used in embodiments of the system shown in FIG. 1.
Figure 3A:
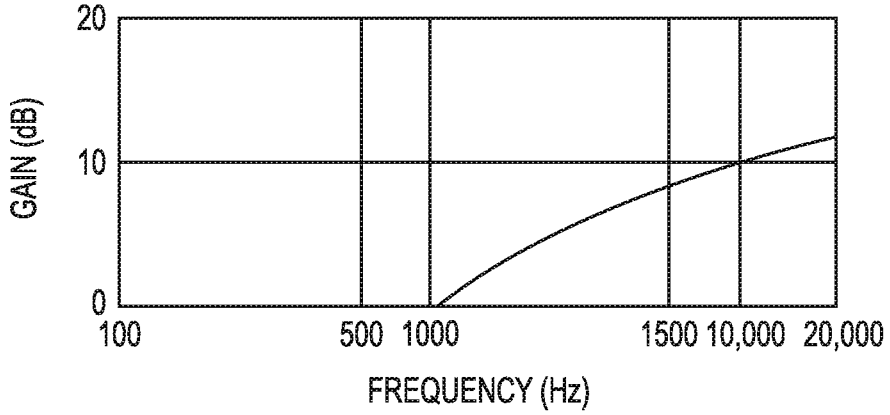
FIGS. 3A-3F are graphs of alternative gain vs. frequency that can be used in embodiments of the system shown in FIG. 1.
Figure 3B:
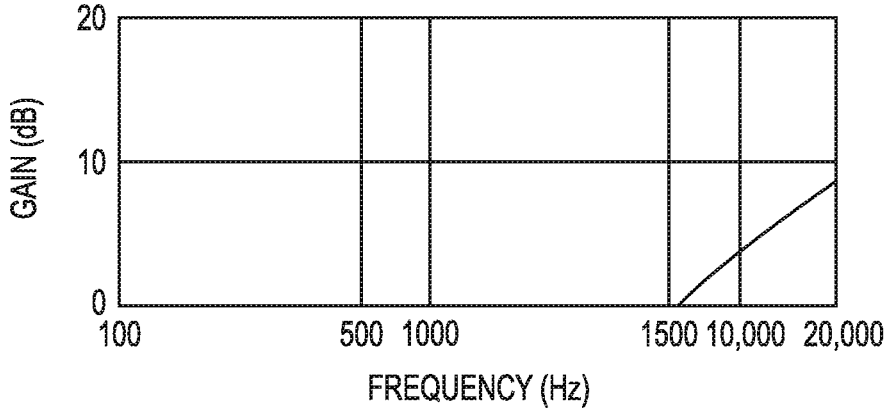
Figure 3C:
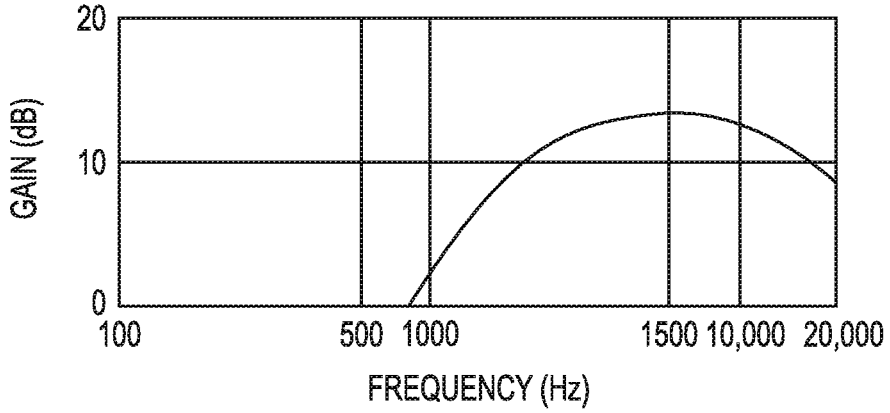
Figure 3D:
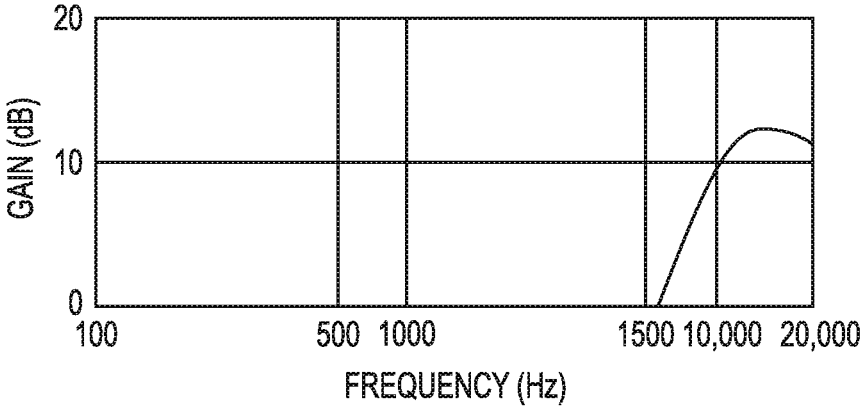
Figure 3E:
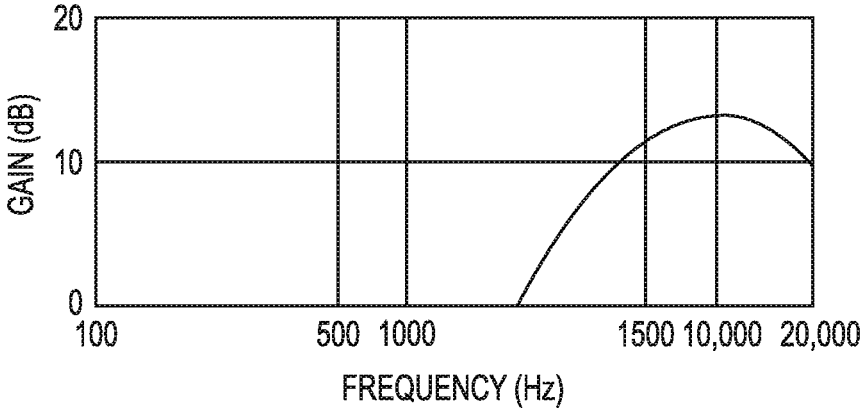
Figure 3F:
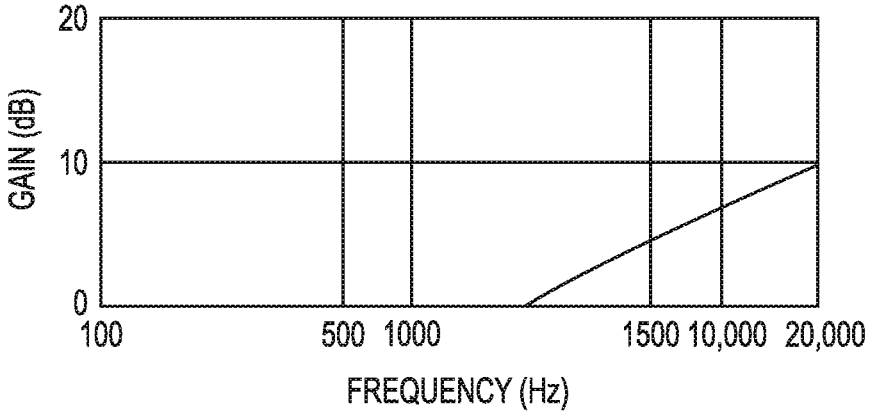

FIG. 2 is a graph of the gain transfer function (i.e., gain vs. frequency) provided by amplifiers 22 and/or 34 in embodiments of the invention. In the embodiment shown, the amplifiers 22 and/or 34 selectively amplify the spectral components of the speech signal that are most relevant to speech intelligibility. In embodiments, the amplified frequency range can have a lower end between about 800 Hz and 1,700 Hz, and an upper end between about 7,000 Hz and 11,000 Hz. In other embodiments the lower end of the amplified frequency range is between about 1,000 Hz and 1,500 Hz, and the upper end of the amplified frequency range is about 8,000 and 10,000 Hz. The amount of amplification of the speech signals at the lower end of the amplified frequency range can be about 5 db or less (e.g., down to about 0 db). Similarly, the amount of amplification of the speech signals at the upper end of the amplified range can be about 5 db or less (e.g., down to about 0 db). In the embodiment shown in FIG. 2 the gain generally increases from the value at the lower end of the amplified range to a maximum value at frequencies between about 3,000 Hz and 4,500 Hz, and generally decreases from the maximum value to the value at the upper end of the amplified range. The maximum amplification value can, for example, be between about 10 db and 30 db. As is also shown in FIG. 2, the amount of amplification can be selected by the user, for example through the use of the volume control knob 37.

The amplification frequency thresholds of the amplifiers 22 and/or 34 (i.e., the frequencies at which the amplification begins and/or ends), and the amplification transfer function of the amplifier, can vary in different embodiments of the invention. In general, the amplifiers 22 and/or 34 are configured to amplify sound having frequencies above the range of significant portions of ambient noise in the sound. For example the amplification threshold frequency and/or transfer function of a version of the system 10 adapted for use in an airplane may be different than one adapted for use in an outdoor street setting. In general, the speech intelligibility index (SII) assumes that speech recognition increases in direct proportion to speech spectrum audibility, which can be calculated from the hearing thresholds of the listener, and the long term average spectra of the speech and noise reaching the ear of the listener. $SII=\Sigma IiAi$ where Ii is the function that characterizes the importance of the ith frequency band to speech intelligibility, and Ai expresses the proportion of the speech dynamic range in the ith frequency band that is above the listener's threshold or masking noise. Noise and other relatively low-frequency components of the sound signals that typically do not contain information important to the intelligibility of the speech, and that can detract from the ability of the hearing impaired to derive useful information from the sound, are effectively filtered out. Amplifiers 22 and/or 34 therefore do not add proportional perceived noise into the environment, while enhancing the volume of the information-containing content of the sound spectrum. Reverberations from room acoustics can also be significantly reduced by system 10, another factor contributing to the enhanced speech intelligibility provided by the system.

In summary, the components of speech processing system 10 cooperate to increase the volume of the frequency portions of the sound received by microphone 20 that commonly contain speech content that can be perceived by hearing impaired individuals. Other embodiments of the invention (not shown) include output limiters in the talker unit 12 and/or listener unit 14 to limit the overall volume of the sound outputted by the speaker 42 to safe operating levels. The content of the speech provided by the earpiece 16 can therefore be understood by hearing impaired individuals better (i.e., is more intelligible) than the original sound containing the speech received at talker unit 12. Complications associated with hearing loss can thereby be reduced, enhancing overall quality of life. For example, system 10 can be a portable or stationary device used in home settings to overcome distance during speaking. It can also be used in noisy environments such as in meetings and restaurants to enhance intelligibility. Other common daily settings where system 10 can enhance the quality of life of hearing impaired individuals include shopping, medical care appointments, and transportation (e.g., while on airplanes, cars and buses). Effectiveness of communications and safety can also be enhanced through use of system 10. Tests have demonstrated significant improvements (e.g., on the order of 20%) in word understanding with gain transfer functions such as those shown in FIG. 2 with maximum gain values of about 14 db.

Speech processing system 10 can be implemented in any of a number of additional embodiments. For example, the system 10 can have a plurality of listener units 14 used by different users (e.g., in the course of a conversation). Similarly, the system 14 can have a plurality of talker units 12 that communicate with one or more listener units 14. Talker unit 12 and listener unit 14 can be configured for packet based communication protocols such as those described in the Dunn U.S. Patent Application Publication 2010/0166209. Talker unit 12 and listener unit 14 can have clips or lanyards to enable the units to be conveniently attached to or worn by the users. Other user interface functionality such as on/off switches, controls and displays can be incorporated into the talker unit 12 and listener unit 14. An advantage of the use of sound distribution tube 44 is that the end of the tube can be positioned near the user's ear canal to provide the speech from the speaker 42 to the user, while enabling the ear canal to remain open to receive ambient sounds (and also enabling the use of the device by users with hearing aids). In other embodiments of the invention (not shown) the earpiece 16 is an in-ear device. Yet other embodiments of the invention (not shown) have wireless technology (e.g., Bluetooth) to couple the speech content signals from the listener unit 14 to the earpiece 16. In still other embodiments (not shown) the components and functionality of the listener unit 14 are incorporated into the earpiece 16.

Figure 4:
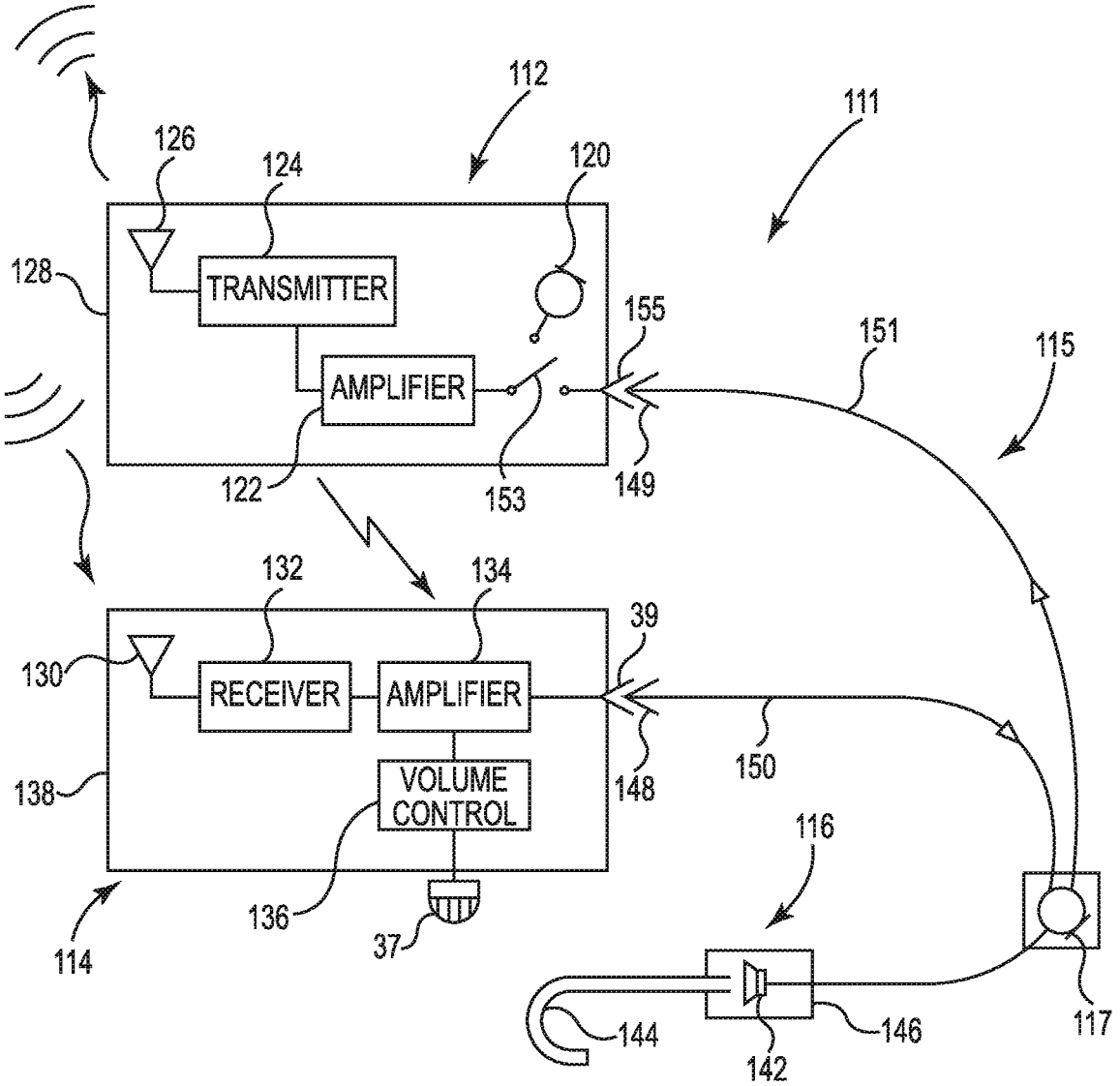
FIG. 4 is a block diagram of another speech intelligibility enhancement system in accordance with embodiments of the present invention.
Figure 6:
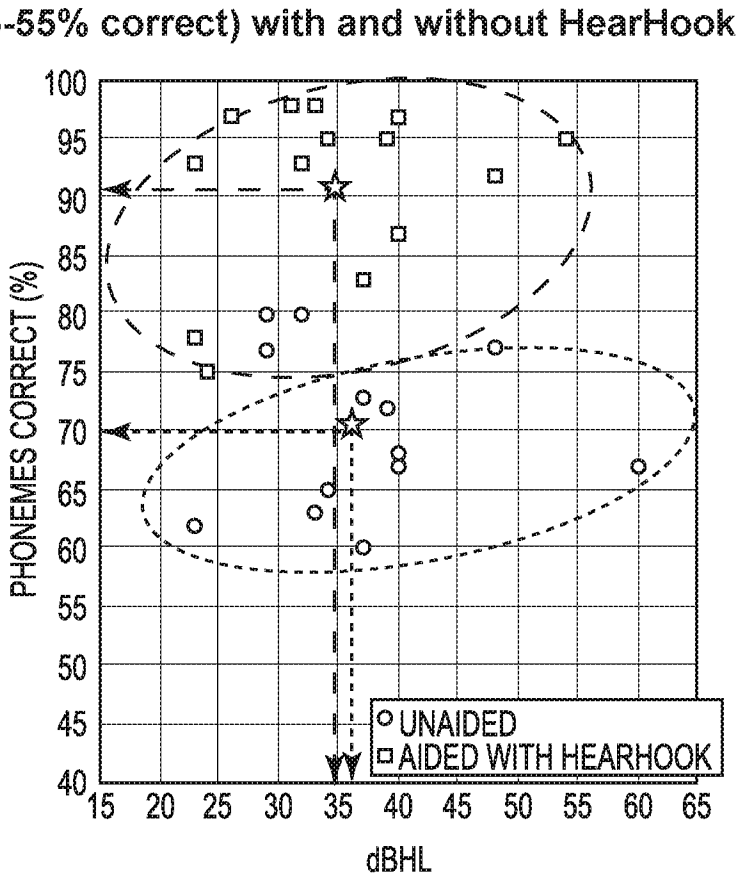
FIG. 6 is a graph of performance data showing sentences recognition of test participants using (i.e., aided by) and not using (i.e., unaided by) a prototype speech intelligibility enhancement system in accordance with embodiments of the invention.
Figure 5:
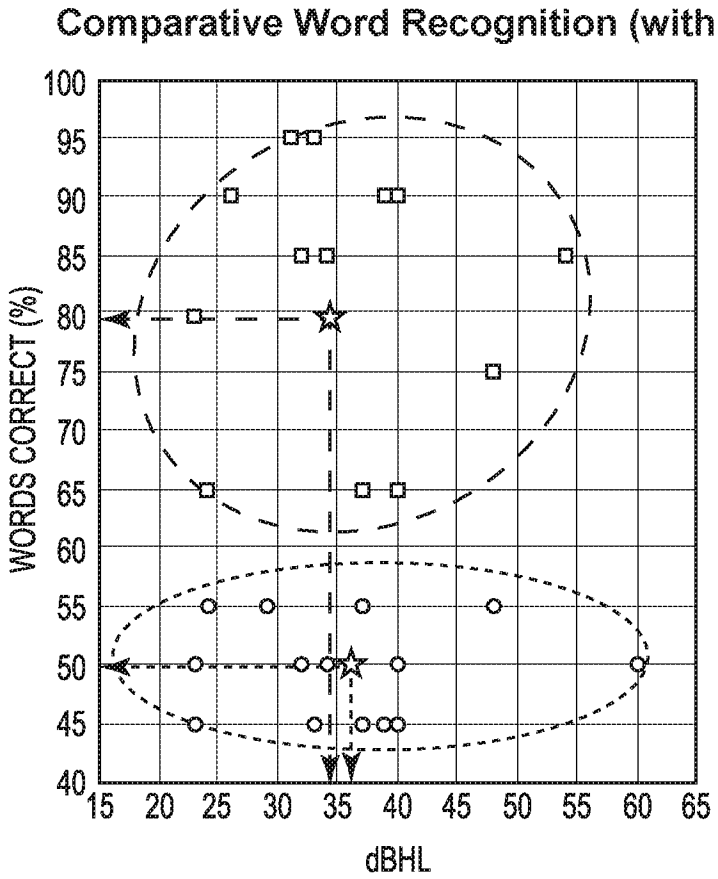
FIG. 5 is a graph of performance data showing words and phonemes recognition of test participants using (i.e., aided by) and not using (i.e., unaided by) a prototype speech intelligibility enhancement system in accordance with embodiments of the invention at a range of ambient noise levels.
Figure 7:
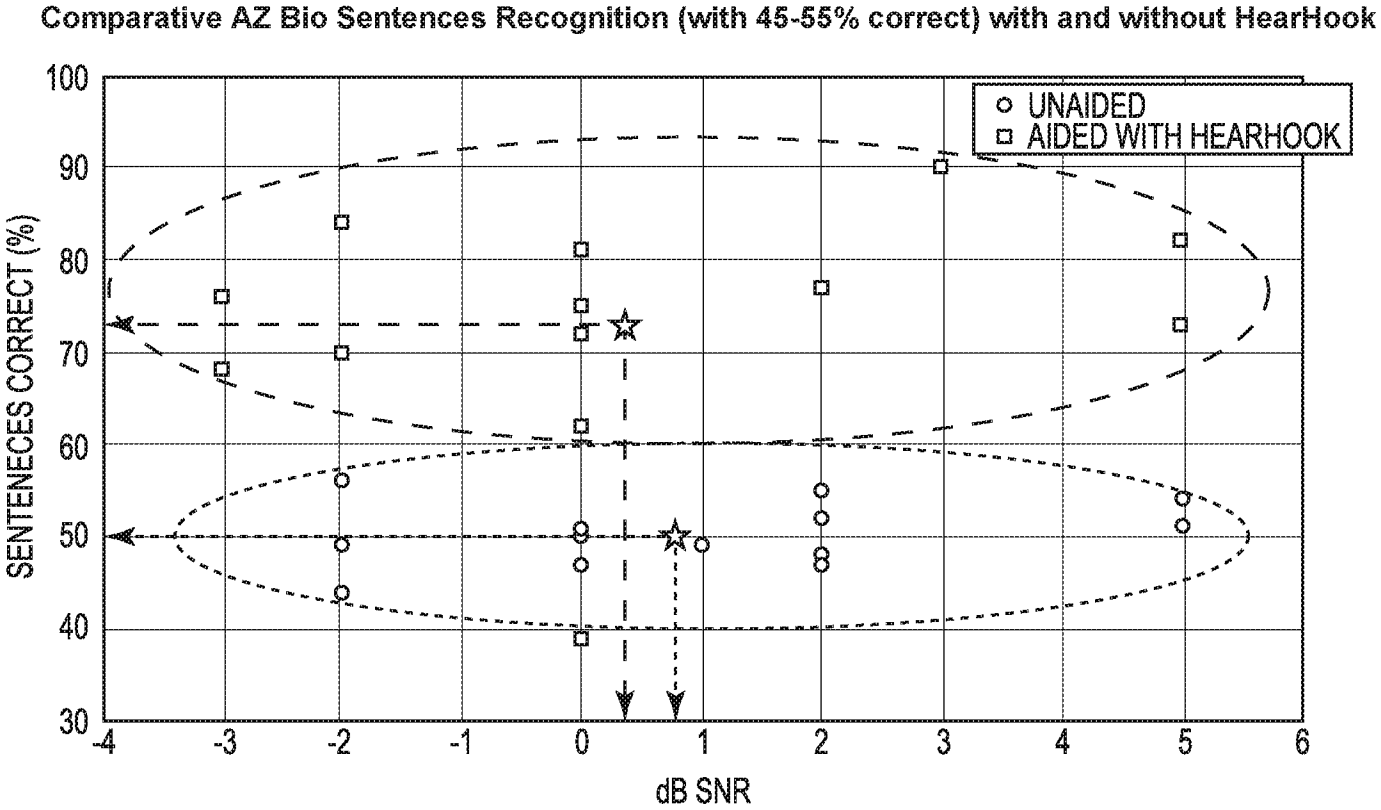
FIG. 7 is a graph of performance data showing sentences recognition of test participants using (i.e., aided by) and not using (i.e., unaided by) a prototype speech intelligibility enhancement system in accordance with embodiments of the invention at a range of ambient noise levels.
Figure 8:
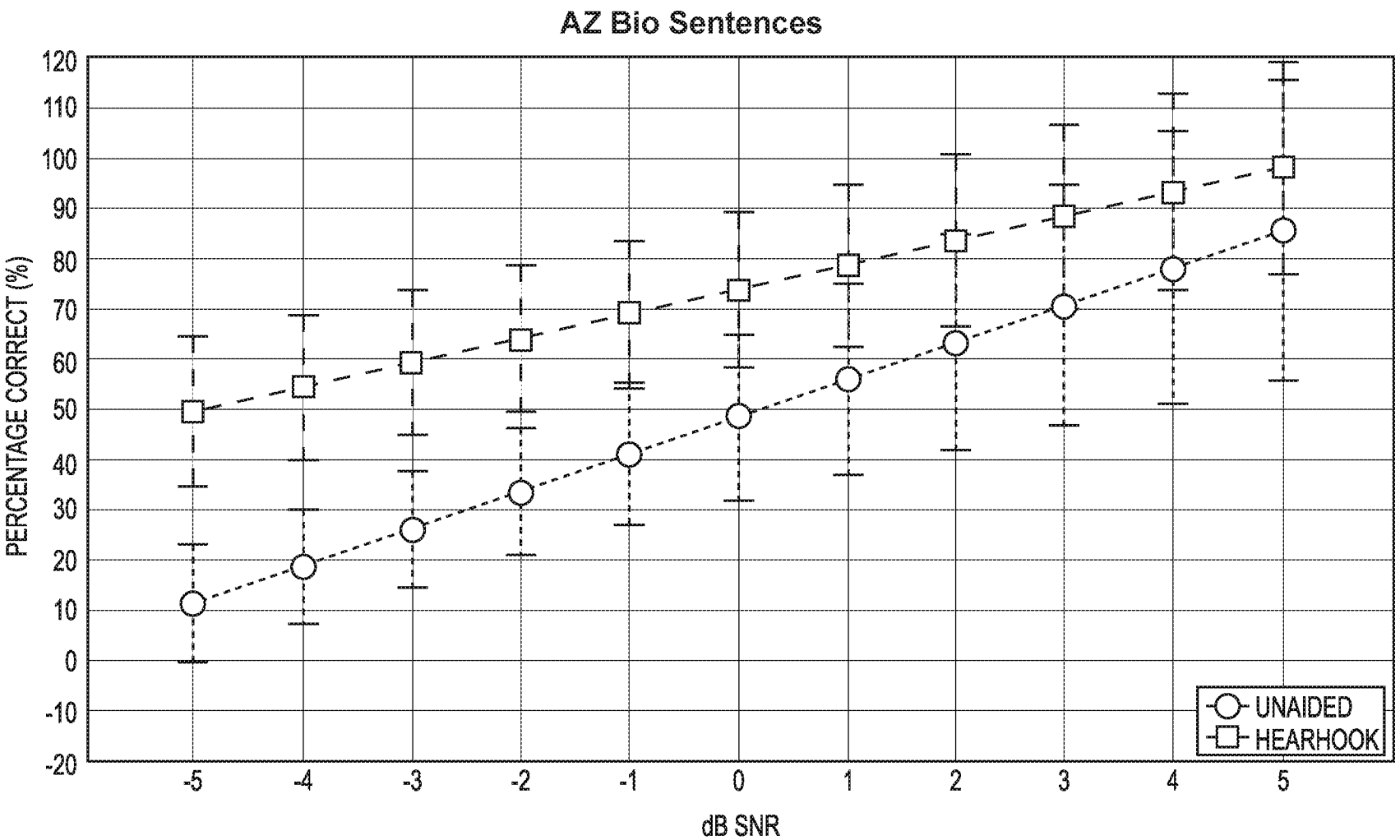
FIG. 8 is a graph of performance data showing sentences recognition of test participants using (i.e., aided by) and not using (i.e., unaided by) a prototype speech intelligibility enhancement system in accordance with embodiments of the invention at a range of ambient noise levels.

FIG. 4 is an illustration of a talker/listener speech intelligibility enhancement system 111 in accordance with embodiments of the invention. As shown, talker/listener system 111 includes a transmitter or talker unit 112, a receiver or listener unit 114 and headset 115. Talker unit 112 and listener unit 114 are configured to be used by the same user. Although shown as having separate housings 128 and 138 in FIG. 4, in other embodiments the housings are joined together, or the functional components of the units are combined in a common housing. The components, including antenna 130, receiver 132, amplifier 134 and volume control 136, and functionality of listener unit 114 can be the same as or similar to those of listener unit 14, described above, and similar reference numbers are used to identify similar components. In particular, amplifier 134 can have the gain transfer functions described above in connection with system 10.

Headset 115 includes an earpiece 116 and microphone 117. The components and functionality of earpiece 116, including ear hook 140, speaker 142 and sound distribution tube 144, can be the same as or similar to those of earpiece 16 described above, and similar reference numbers are used to identify similar components. The speaker 142 is coupled through wires 150 to a plug 148 that connects to the jack 139 of the listener unit 114. Microphone 117 is coupled through wires 151 to a plug 149. In embodiments, headset 115 can have two earpieces 116, one for each ear of the user. Embodiments of headset 115 can also include other structures for coupling sound to the user's ear or ears, such as ear tips. By way of example, headset 115 can be a HF3 headset available from Etymotic Research of Elk Grove Village, Ill.

Talker unit 112 includes a microphone 120, amplifier 122, transmitter 124 and antenna 126 that can function in a manner that is the same as or similar to those of talker unit 12, described above, and similar reference numbers are used to identify similar components. In particular, amplifier 122 can have the gain transfer functions described above in connection with system 10. As shown, talker unit 112 includes a switch 153 that can be actuated to couple microphone 120 or an input connection or jack 155 to the amplifier 122. Jack 155 is configured to be coupled to the plug 149 of headset 115. A user of talker/listener system 111 can thereby operate the system to receive speech through the microphone 117 of the headset 115 or through the microphone 120 of the talker unit 112 (e.g., by actuating the switch 153). An amplified speech content signal produced by the talker unit 112 can be transmitted, for example to the listener unit 114 of the system 111, to one or more other listener/talker systems (not shown) such as 111 being used by another person, and/or to one or more listener units 14 of the type described above. In other embodiments, the speech content signal produced by the talker unit 112 is transferred by a wired connection to the associated listener unit 114 of the system 111 (e.g., as opposed to the wireless transmission shown in FIG. 4).

FIGS. 5-8 are graphs of performance data obtained from participants during a study using a prototype speech intelligibility enhancement system in accordance with embodiments of the invention. The prototype device used for the study, referred to below as the HearHook device, was substantially the same as the system 10 described above, and had gain v. frequency characteristics of the type illustrated in FIG. 2.

All participants completed four listening conditions: 1) unaided word recognition in quiet; 2) aided word recognition in quiet; 3) unaided speech recognition in noise; and 4) aided speech recognition in noise. The participants wore the HearHook device in the aided condition and did not in the unaided condition. Hearing aid users enrolled in the study removed their hearing aids prior to all test conditions. The unaided and aided conditions were randomized for both word recognition and speech in noise testing. Periodic breaks were provided as needed throughout testing.

For the aided conditions, the HearHook receiver was coupled to both ears using small flexible open-fit ear hooks. The HearHook transmitter was hung four inches from the target speaker. This was done to mimic the lapel microphone transmission distance. The amount of high-frequency gain applied with the HearHook system was constant across all participants, with a peak gain of 17 dB between 1000 Hz to 4000 Hz.

Word recognition in quiet was completed in sound field. Stimuli were phonemically-balanced recorded consonant-vowel-consonant (CVC) monosyllabic word lists (English Speech Audiometry, Brigham Young University, 1998). Two lists of 10 phonemically-balanced words were scored for both the aided and unaided conditions. The presentation level in dB HL was adjusted adaptively in 3 dB increments to determine the binaural reception threshold for words (RTW), or when the participant correctly scored between 45% and 55% of the words. The percent of words correct was also recorded at two to three presentation levels above and below the threshold. Percent correct for isophonemes was also calculated for threshold presentation level, as well as two to three additional presentations above and below to confirm findings.

Speech in noise testing was conducted using adult AzBio sentences and noise. Listeners heard recorded AzBio sentences from the front speaker in a calibrated eight-speaker R-SPACE array ("Developing and Testing a Laboratory Sound System That Yields Accurate Real-World Results," hearingreview.com, October, 2007). The R-SPACE system was chosen for this study to test the HearHook device in the most accurate laboratory simulation of real-world acoustic environments possible {Compton-Conley, 2004 #129}. The Lou Malnati stimulus was created from live restaurant sounds recorded with a KEMAR manikin at a popular pizzeria in Chicago, Ill., and was used to mimic as real-world a restaurant environment as possible for this study. This omnidirectional restaurant noise accompanied the AzBio target sentences at 0 degrees azimuth. Signal levels were initially presented at a signal-to-noise ratio (SNR) of +5 dB and then were adjusted to create various SNRs. The illuminati noise presentation level remained constant at 60 dB SPL. The percent correct was calculated at each SNR presentation level. The SNR was adjusted adaptively to determine the binaural reception threshold of sentences (RTS) or the SNR at which the participant scored between 45 to 55% words correct. The percent words correct was recorded for the SNR at RTS and two to three additional SNRs above and below this presentation level to confirm findings.

A total of 14 participants with sensorineural hearing loss were included in the study (10 female, 4 male) with a mean age of 73.4 years (SD=±8.5; range: 56-86 years). Of the 14 participants, seven were experienced hearing aid users and seven had never worn hearing aids. Audiometric data resulted in slight to severe sloping sensorineural hearing across the group.

In connection with word recognition in quiet, in the aided condition, the RTW improved by 9.29 dB compared to the unaided condition. Using paired sample t-test, these two conditions were significantly different ($t=6.52$, $df=13$, $p<0.0001$).

In connection with speech in noise, in the aided condition, the RTS improved by an SNR of 4.71 dB compared to the unaided condition. Using paired sample t-test, these two conditions were significantly different ($t=9.95$, $df=13$, $p<0.0001$)

Although the invention has been described with reference to preferred embodiments, those skilled in the art will recognize that changes can be made in form and detail without departing from the spirit and scope of the invention. Although described in connection with use by hearing impaired individuals, the device can be used by anyone with a desire for better speech understanding (e.g., to overcome listening problems relating to distance, noise and/or reverberation), in a wide range of locations such as in conference rooms.

The invention claimed is:

1. A speech intelligibility enhancement system, comprising:

a talker unit including:

a microphone to receive audible speech content and to produce electrical signals representative of the speech content; and a transmitter coupled to the microphone to produce wireless transmissions containing the speech content; and a listener unit including:

a receiver to receive the wireless transmissions and to produce electrical signals representative of the speech content; and an earpiece coupled to the listener unit, including:

an ear hook wearable by the user;

a speaker coupled to the listener unit to produce audible speech content having the amplified spectral components; and a tube, a part of which comprises the ear hook, wherein the tube has an open first end to be positioned near a user's ear canal to direct the audible speech content from the speaker toward the user's ear canal, while enabling the ear canal to remain open to receive ambient sounds: and wherein:

the tube is configured to be mounted to a user's ear and support the earpiece on the user's ear;

the open first end of the tube is free from an earbud;

the part of the tube which comprises the ear hook includes a curved portion to couple the earpiece to the user's ear and an elongate portion extending from the curved portion, wherein the curved portion is defined by a first radius of curvature, and wherein the elongate portion includes an extending portion that is relatively linear in relation to the curved portion and is defined by a second radius of curvature that is greater than the first radius of curvature;

the tube further includes a second end on the elongate portion opposite the curved portion from the first end; and the speaker is on the second end of the tube.

2. The speech intelligibility enhancement system of claim 1 and further including a wired connection between the listener unit and the earpiece speaker.

3. The speech intelligibility enhancement system of claim 1 wherein the amplifier is in the talker unit.

4. The speech intelligibility enhancement system of claim 3 and further including a wired connection between the listener unit and the earpiece speaker.

5. The speech intelligibility enhancement system of claim 1 wherein the amplifier is in the listener unit.

6. The speech intelligibility enhancement system of claim 5 and further including a wired connection between the listener unit and the earpiece speaker.

7. The speech intelligibility enhancement system of claim 1, wherein at least one of the talker unit and the listener unit includes an amplifier to amplify spectral components of the speech content within a frequency range having a lower end between about 800 Hz and 1,700 Hz and an upper end between about 7,000 Hz and 11,000 Hz, and wherein a gain of the amplifier generally increases from a first value for spectral components at the lower end of the amplified frequency range to a second and maximum value for spectral components within a frequency range between about 3,000 Hz and 4,500 Hz, and decreases from the maximum value to a third value for spectral components at the upper end of the amplified frequency range.

8. The speech intelligibility enhancement system of claim 7 wherein the first gain value is about 5 db or less.

9. The speech intelligibility enhancement system of claim 8 wherein the second and maximum gain value is between about 10 db and about 30 db.

10. The speech intelligibility enhancement system of claim 9 wherein the third gain value is about 5 db or less.

11. The speech intelligibility enhancement system of claim 1 wherein:

the earpiece is a component of a headset and the headset includes a microphone; and the headset is configured to couple the microphone to the talker unit.

12. The speech intelligibility enhancement system of claim 11, and further including a switch to couple the talker unit to one of the microphone of the talker unit or the microphone of the headset.

13. The speech intelligibility enhancement system of claim 12, wherein the talker unit and listener unit are joined.

14. A speech intelligibility talker unit configured for use with a listener unit coupled to an earpiece, the talker unit configured to be coupled to a source of speech content and including an amplifier to amplify spectral components of the speech content within a frequency range having a lower end between about 800 Hz and 1,700 Hz and an upper end between about 7,000 Hz and 11,000 Hz, wherein the earpiece includes an ear hook wearable by a user, a speaker coupled to the listener unit to produce audible speech content having the amplified spectral components, and a tube, a part of which comprises the ear hook, wherein the tube has an open first end to be positioned near the user's ear canal to direct the audible speech content from the speaker toward the user's ear canal, while enabling the ear canal to remain open to receive ambient sounds; and wherein:

the tube is configured to be mounted to a user's ear and support the earpiece on the user's ear;

the open first end of the tube is free from an earbud;

the part of the tube which comprises the ear hook includes a curved portion to couple the earpiece to the user's ear and an elongate portion extending from the curved portion, wherein the curved portion is defined by a first radius of curvature, and wherein the elongate portion includes an extending portion that is relatively linear in relation to the curved portion and is defined by a second radius of curvature that is greater than the first radius of curvature;

the tube further includes a second end on the elongate portion opposite the curved portion from the first end; and the speaker is on the second end of the tube.

15. The speech intelligibility talker unit of claim 14 wherein a gain of the amplifier generally increases from a first value for spectral components at the lower end of the amplified frequency range to a second and maximum value for spectral components within a frequency range between about 3,000 Hz and 4,500 Hz, and decreases from the maximum value to a third value for spectral components at the upper end of the amplified frequency range.

16. The speech intelligibility talker unit of claim 14 and further including a microphone to provide the speech content.

17. A speech intelligibility listener unit coupled to an earpiece and configured for use with a talker unit, the listener unit configured to be coupled to a source of speech content and including an amplifier to amplify spectral components of the speech content within a frequency range having a lower end between about 800 Hz and 1,700 Hz and an upper end between about 7,000 Hz and 11,000 Hz, and wherein the earpiece includes an ear hook wearable by a user, a speaker coupled to the listener unit to produce audible speech content having the amplified spectral components, and a tube, a part of which comprises the ear hook, wherein the tube has an open first end to be positioned near the user's ear canal to direct the audible speech content from the speaker toward the user's ear canal, while enabling the ear canal to remain open to receive ambient sounds; and wherein:

the tube is configured to be mounted to a user's ear and support the earpiece on the user's ear;

the open first end of the tube is free from an earbud;

the part of the tube which comprises the ear hook includes a curved portion to couple the earpiece to the user's ear and an elongate portion extending from the curved portion, wherein the curved portion is defined by a first radius of curvature, and wherein the elongate portion includes an extending portion that is relatively linear in relation to the curved portion and is defined by a second radius of curvature that is greater than the first radius of curvature;

the tube further includes a second end on the elongate portion opposite the curved portion from the first end; and the speaker is on the second end of the tube.

18. The speech intelligibility listener unit of claim 17 wherein a gain of the amplifier generally increases from a first value for spectral components at the lower end of the amplified frequency range to a second and maximum value for spectral components within a frequency range between about 3,000 Hz and 4,500 Hz, and decreases from the maximum value to a third value for spectral components at the upper end of the amplified frequency range.

19. The speech intelligibility listener unit of claim 17 and further including an earpiece having a speaker coupled to receive the amplified spectral components of the speech content.

20. The speech intelligibility enhancement system of claim 1 wherein the tube is a one-piece member.

21. The speech intelligibility enhancement system of claim 20 wherein the tube has a constant diameter.

22. The speech intelligibility talker unit of claim 14 wherein the tube is a one-piece member.

23. The speech intelligibility talker unit of claim 22 wherein the tube has a constant diameter.

24. The speech intelligibility listener unit of claim 17 wherein the tube is a one-piece member.

25. The speech intelligibility listener unit of claim 24 wherein the tube has a constant diameter.

* * * * *